US005993955A

United States Patent [19]

Mense

[11] Patent Number: 5,993,955

[45] Date of Patent: Nov. 30, 1999

[54] FOAM MOULDING WITH INTEGRALLY MOULDED ANCHORING ELEMENT

[75] Inventor: Hubert Mense, Prichsenstadt, Germany

[73] Assignee: F.S. Fehrer GmbH & Co. KG, Kitzingen, Germany

[21] Appl. No.: 09/068,272

[22] PCT Filed: Oct. 30, 1996

[86] PCT No.: PCT/DE96/02084

§ 371 Date: May 21, 1998

§ 102(e) Date: May 21, 1998

[87] PCT Pub. No.: WO97/16093

PCT Pub. Date: May 9, 1997

[30] Foreign Application Priority Data

Nov. 2, 1995 [DE] Germany ..... 195 40 714

[51] Int. Cl.[6] ..... A47C 7/18; B32B 5/22

[52] U.S. Cl. ..... 428/317.9; 52/740.7; 297/452.6; 297/452.61

[58] Field of Search ..... 428/317.9; 52/740.7; 297/452.26, 452.35, 452.45, 452.61, 452.6

[56] References Cited

U.S. PATENT DOCUMENTS

| | | | |
|---|---|---|---|
| 3,649,975 | 3/1972 | Baruth et al. | 5/345 |
| 3,961,823 | 6/1976 | Caudill, Jr. | 297/452 |
| 4,452,488 | 6/1984 | Ruginenius | 297/452 |
| 5,538,785 | 7/1996 | Dingher | 428/317.9 X |

FOREIGN PATENT DOCUMENTS 295 06 306 12/1995 Germany .

*Primary Examiner*—Daniel Zirker
*Attorney, Agent, or Firm*—Darby & Darby

[57] ABSTRACT

A foam moulding is proposed having an integrally moulded anchoring element, by means of which the moulding is capable of being connected to other components, in particular to a cover, the anchoring element being a filament (2) of organic material extending parallel to the surface of the cushion.

10 Claims, 2 Drawing Sheets

FOAM MOULDING WITH INTEGRALLY MOULDED ANCHORING ELEMENT

FIELD OF THE INVENTION

The invention relates to a foam moulding with an integrally moulded anchoring element, by means of which the moulding is capable of being connected to other components, in particular to a cover.

BACKGROUND OF THE INVENTION

The mechanical load-bearing capacity of foams is comparatively low, particularly in relation to tensile forces. If foam mouldings are to be connected to other components so as to be capable of bearing tensile loads it is therefore conventional in the state of the art either to undertake adhesion-bonding over a large area or to make use of anchoring elements in order to guarantee distribution of the forces over a wide area and to avoid point-focal loads that would result in fissure of the foam.

Particularly in vehicle construction, cushioning elements frequently consist of a central foam moulding, the surface of which is provided with a cover, usually a fabric or leather. In order to permit fastening of the cover at individual points or along a seam with the foam core there are integrally moulded within the foam one or more wires, to which the cover is connected by means of fastening elements, for example by filaments or hooks. By virtue of a taught connection, indentations are formed in the region of the junction points on the surface of the cushion which improve the fixation of the cover and contribute to the optical and functional design of the surface. With a suitable shape of the foaming tool it is possible to ensure that the points of attachment to the wire are freely accessible through recesses in the moulding, so that establishment of the connection is alleviated. By way of foams, use is made predominantly of polyurethanes which are produced by polyaddition of polyhydric alcohols with polyisocyanates. In this connection a reaction of the isocyanate with the hydroxyl group characterising the alcohol takes place. This state of the art can be inferred from U.S. Pat. No. 3,649,974, the disclosure of which is hereby incorporated by reference.

The wires that are customary for anchoring adhere to the foam comparatively poorly—ie, the connection is effected almost exclusively by means of the form closure brought about by the integral moulding within the foam. With a view to achieving an adequate load-bearing capacity a sufficient cross-section of the wire is therefore required which, however, results in an increased weight which is disadvantageous for reasons of energy economy, particularly in vehicle construction. Moreover it is necessary to keep wires of various lengths in stock for different applications, considerably increasing the effort expended on storage. Finally, after they have been used, foam parts are frequently recycled by being shredded into flakes or by chemical dissolution. Both processes are impaired or hindered by metallic anchoring elements, so the wires have to be removed beforehand in elaborate manner.

OBJECT OF THE INVENTION

Against this background the object of the invention is to develop a foam moulding having an anchoring element wherein the mechanical load-bearing capacity of the connection is increased, the weight of the cushioning element is lowered and customary recycling processes are not impaired.

In accordance with the invention this object is achieved through the anchoring element being a filament (2) of organic material extending parallel to the surface of the cushion.

DETAILED DESCRIPTION OF THE INVENTION

The initial concept of the invention consists in making use of a filament by way of anchoring element that extends parallel to the surface of the cushion within its interior. The filament, which is preferably freely accessible in individual regions through recesses in the foam moulding, corresponds in its function to the wires that are customary in the state of the art. In particular it is possible to fasten a component such as a cover to the anchoring element repeatedly, along a seam for example. Besides the advantages of low weight and firm adhesion to the foam, a filament is distinguished by high flexibility, so that it adapts well to deformations of the cushion and the risk of its being torn out is diminished. Particularly in the case of filaments consisting of fibres that are interwoven or spun, an intense form closure arises with the surrounding foam which, by reason of low viscosity in the liquid state, penetrates into the capillary pores and interstices of the filament in the course of the foaming process. Hence the adhesion-promoting surface is enlarged considerably in comparison with a wire, so that greater forces can be transmitted from the anchoring element to the foam. Furthermore, filaments can be arbitrarily divided with very little effort, so that the cut to size may optionally be effected even after a foaming process and no stockpiling of filaments of different lengths is necessary.

Besides the high mechanical load-bearing capacity of the connection, the moulding is distinguished by reduced weight, since as a rule the density of organic media is clearly lower than that of metals. Moreover, neither shredding nor chemical dissolution of the foam is hindered in the course of recycling. The anchoring elements according to the invention may be employed in all customary reaction processes for the production of foams, especially polyaddition and polycondensation processes.

In an advantageous further development of the invention the mechanical adhesion between anchoring element and foam is reinforced by chemical bonds. The central idea in this case is to make use of an anchoring element presenting functional chemical groups on its surface that are also available on an educt of the foam and are involved in the reaction for its formation. If polyhydric alcohols are involved in the reaction process via their hydroxyl groups, a method that therefore suggests itself is to make use of anchoring elements having a surface terminated by hydroxyl groups. A large number of animal-based or plant-based substances are suitable as materials for the anchoring element, since carbohydrates such as cellulose in particular are provided with readily accessible hydroxyl groups. Since the superficial hydroxyl groups of the anchoring element enter into chemical reactions in the same way as do the hydroxyl groups of the polyhydric alcohol, over and above the form closure an intense chemical bond is consequently effected between element and foam—ie, a cross-linking with the molecules thereof.

The adhesion between foam and anchoring element can be improved further if the surface of said anchoring element is structured in the manner of a relief, for example if it is corrugated or serrated. In this case, besides the chemical bond a form closure is additionally effected.

Preferred materials for the anchoring element are natural fibres that, superficially, present terminal hydroxyl groups and are structured on a microscopic linear scale. Suitable materials are, for example, (long-stapled) hemp or jute, which have a high capacity for bearing tensile loads. Besides their introduction into the foam in the form of individual filaments, use in the form of meshes is also conceivable, giving rise to attachment possibilities that are distributed over an area.

Stipulated in particular by way of foam is polyurethane which is formed by polyaddition of diols or polyhydric alcohols with diisocyanates or polyisocyanates.

Tools for the production of a foam moulding having an anchoring element comprise a receiving device into which said anchoring element is inserted prior to the foaming process and in which the element is fixed during the course of the reaction. In a suitable process for the production of a foam moulding according to the invention the filament is firstly clamped into the receiving device. In contrast with the wires that are customary in the state of the art, a tensile load is necessary in this case in order that the position of the flexible filament within the tool is established definitively and is also maintained during the foaming operation. Furthermore, as a result of the prestressing the maximum possible capacity for bearing tensile loads in the integrally moulded state increases. Subsequently the filling-out of the tool with foam and also the removal of the moulding are effected in known manner. The filament is expediently drawn off continuously from a roll and is only cut to size immediately prior to being inserted into the tool, after being clamped into the receiving device or after termination of the foaming process. In this manner the holding of stocks is significantly alleviated, since no anchoring elements of different dimensions need to be stockpiled.

DESCRIPTION OF THE DRAWINGS

Further particulars, features and advantages of the invention may be gathered from the following part of the specification, in which an example of an embodiment of the invention is elucidated in more detail on the basis of the drawing. The drawing shows, in schematic representation:

Figure 1:
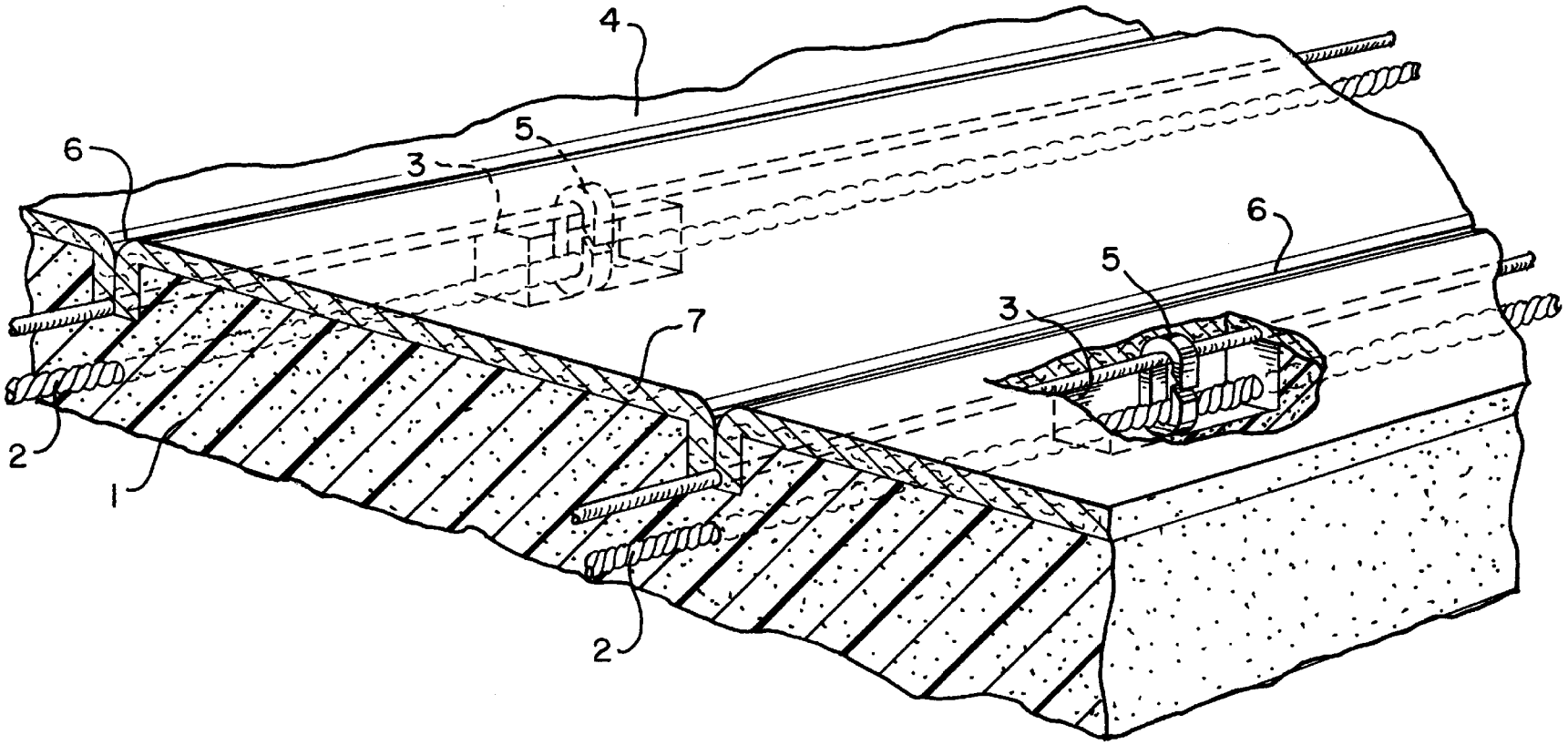
Figure 2:
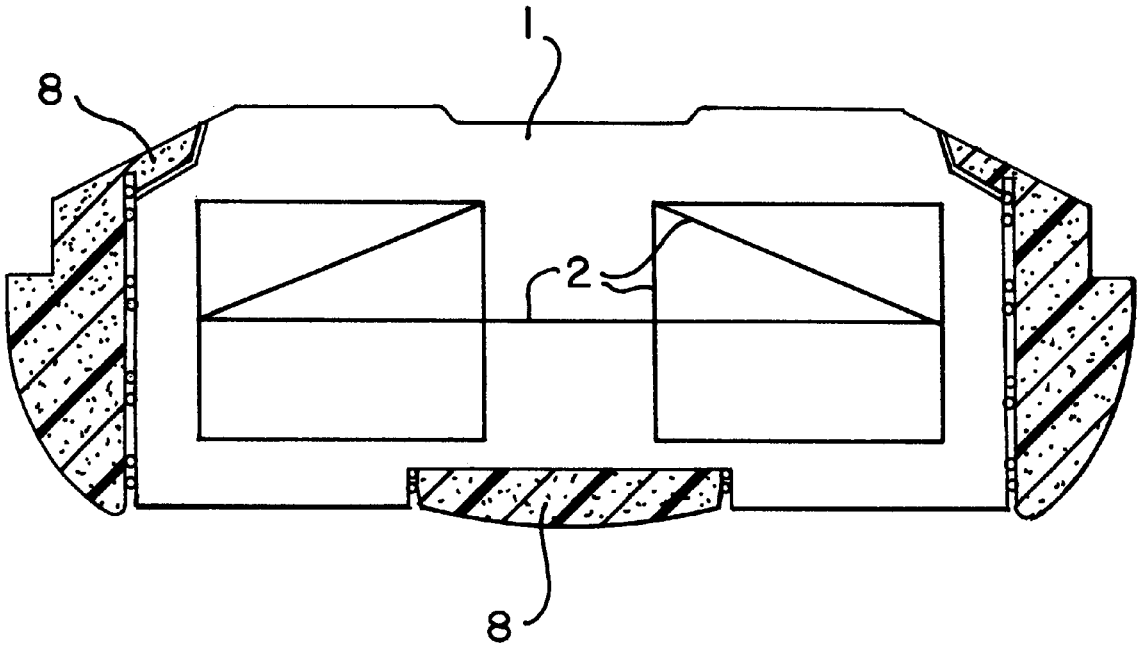

| | |
|---|---|
| FIG. 1 | a cushioning element that has been cut into, with a foam moulding according to the invention |
| FIG. 2 | a section through an alternative foam moulding |

Integrally moulded within the moulding (1) represented in FIG. 1, which preferably consists of polyurethane, are filaments (2) which extend parallel to its surface and which consist, for example, of long-stapled hemp or jute. The filament (2) is accessible through recesses (3) in the moulding (1) which can be produced by circular or angular elevations of the moulding tool and on which the filament (2) may be fixed during the foaming process. The outer cover (4) of the cushioning element is anchored to the filament (2) by means of fastening elements (5), by hooks or filaments for instance, that extend through the recesses (3), whereby, as a result of the tensile load, grooves (6) are formed on the surface of the cushioning element which in each instance extend parallel to filaments (2). A fleece (7) arranged between cover (4) and moulding (1) improves the circulation of air through the cushion and permits its surface to appear softer.

If the moulding (1) is produced using polyhydric alcohols by way of educts of the foam then a filament (2) provided with hydroxyl groups on its surface enters into chemical bonds with the foam. Moreover, an intense form closure arises between filament (2) and surrounding foam. In this manner, with low weight and good recyclability of the material, a very firm and highly loadable connection is guaranteed between anchoring element and moulding (1).

FIG. 2 shows a cross-section through an alternative moulding (1) wherein the filament (2) extends through the foam in the form of a closed traverse. In this manner the fastening of a cover (4) or of another object can be effected from different sides of the moulding (1) to an individual, uninterrupted filament (2) without fastening elements (5) needing to penetrate a large material thickness of the moulding (1). Furthermore it is possible, without subdivision of the filament (2), for different segments parallel to the surface of the cushion to be generated on which anchoring may be effected and hence for a wide range of stitching patterns of a cover to be produced. External regions (8) of the moulding (1) may exhibit different material properties and may be produced integrally with the moulding (1) or attached onto it.

I claim:

1. Foam moulding with an integrally moulded anchoring element for connecting the moulding to one or more other components, wherein the anchoring element comprises a filament (2) of organic material extending parallel to the surface of the cushion.

2. A foam moulding according to claim 1 with a polyhydric alcohol as educt which, as a result of molecular cross-linkages accompanied by cleavage of hydroxyl groups, reacts with other reactive components to form the foam, wherein the surface of the anchoring element presents hydroxyl groups prior to being integrally moulded within the foam.

3. A foam moulding according to claim 1, wherein the component is fastened to the anchoring element at a plurality of points.

4. A foam moulding according to claim 1, wherein the surface of the anchoring element has a relief structure.

5. A foam moulding according to claim 1, wherein the anchoring element comprises natural fibers.

6. A foam moulding according to claim 5, wherein the anchoring element comprises one of hemp or jute.

7. A foam moulding according to claim 1, wherein the foam is polyurethane.

8. A foam moulding according to claim 1, wherein the filament extends in the form of a closed traverse.

9. A process for producing a foam moulding according to claim 1 with a mould that is capable of being filled out with foam and comprises a receiving device for fixing the anchoring element, the process comprising the steps of:

clamping the filament (2) of organic material under tension into the receiving device, filling-out of the mould with foam, and removal of the moulding.

10. A process according to claim 9, wherein the filament (2) is drawn off from a roll and is cut to size one of prior to and after the filing-out with foam.

* * * * *